United States Patent [19]

Novakosky

[11] 4,327,651

[45] May 4, 1982

[54] METHOD AND APPARATUS FOR PROTECTING A FLOOR SAFE FROM WATER DAMAGE

[76] Inventor: James T. Novakosky, 103 Tuscany, Sugar Land, Tex. 77478

[21] Appl. No.: 192,416

[22] Filed: Sep. 29, 1980

[51] Int. Cl.[3] ..... E05G 1/026

[52] U.S. Cl. ..... 109/68; 109/50; 109/75

[58] Field of Search ..... 109/64, 67, 68, 75, 109/50, 51, 52; 404/25, 26; 52/198, 20; 49/463

[56] References Cited

U.S. PATENT DOCUMENTS

| | | | |
|---|---|---|---|
| 306,018 | 9/1884 | Johnston et al. | 109/68 |
| 729,809 | 6/1903 | Thomas | 109/68 |
| 2,935,955 | 5/1960 | Mann | 109/68 |
| 3,490,177 | 1/1970 | Perrion | 49/463 |
| 3,747,541 | 7/1973 | Reese | 109/64 |
| 3,901,167 | 8/1975 | Reese | 109/64 |
| 3,945,329 | 3/1976 | Bywater | 109/68 |
| 4,176,440 | 12/1979 | Lichter | 109/68 |

*Primary Examiner*—Reinaldo P. Machado

*Attorney, Agent, or Firm*—Pravel, Gambrell, Hewitt, Kirk, Kimball & Dodge

[57] ABSTRACT

A method and apparatus for protecting a floor safe from water damage including an outer shell member mounted in an annular area formed between the case or housing of the floor safe and the foundation in which the floor safe is mounted; a protective enclosure including a lower rim portion is mounted over the floor safe case and held in position by retainer pins which extend through the outer shell member into engagement with the lower protective cap rim portion, the protective enclosure trapping air between the enclosure and the floor safe for providing an air pressure barrier to resist the intrusion of water into the area of the openable floor safe top.

11 Claims, 2 Drawing Figures

METHOD AND APPARATUS FOR PROTECTING A FLOOR SAFE FROM WATER DAMAGE

BACKGROUND OF THE INVENTION

The field of this invention relates to the protection of floor safes or other similarly mounted devices.

Safes for homes or businesses are typically mounted either in a wall or a floor. Wall safes are particularly subject to the hazards of fire but, are not subject to water damage so long as mounted sufficiently high from the floor. On the other hand, floor safes are not as susceptible to damage from fire since the floor foundation does not typically reach the hot temperature found in the remainder of a burning building. But, floor safes are subject to water intrusion through the operable top. One solution is to make the floor safe opening water-tight. But, the type of sealing that makes the door of the floor safe water-tight also makes it air-tight. Making the safe air-tight causes problems with moisture damage to valuables contained in the safe and with air expansion within the safe which may occur from fire or simply a hot environment. Air expansion may actually cause a safe top to blow off.

During a search conducted in the U.S. Patent and Trademark Office, the most pertinent reference to this invention found was U.S. Pat. No. 3,945,329 of Bywater. The Bywater patent discloses a water barrier lid which is adapted for mounting over the top of the floor safe and includes a sealing O-ring extending about the circular periphery of a relatively rigid rim, the O-ring sealably engaging an inner surface of the case of the floor safe. U.S. Pat. No. 3,747,541 discloses a safe top which includes a door having a pair of axially spaced apart circular plates having an expandable cylindrical collar disposed between the plates; a screw extends through the plate and is rotatable to draw the plates closer together and thereby expand the cylindrical collar into sealing engagement against the side of the safe casing. Other U.S. patents found in the search include U.S. Pat. No. 2,935,955 which is directed to a wall safe and U.S. Pat. No. 3,490,177 which is directed to a hatch.

SUMMARY OF THE INVENTION

This invention relates to an apparatus for preventing water damage to a floor safe or other similarly mounted device and includes a protective means adapted for positioning over the openable top and part of the casing of a floor safe for trapping air between the protective means and the floor safe to prevent the intrusion of water into the region of the openable top of the floor safe by utilizing the pressure of the trapped air to resist pressure of the protruding water. The protective means of the apparatus of this invention includes a protective enclosure including a substantially cylindrical housing having a top attached therewith and being adapted for mounting over the openable top and a part of the casing of the floor safe. The protective enclosure includes a lower rim portion in which is held in place by a retainer means which becomes operable upon rotation of the protective housing into place after lowering downwardly over the floor safe. In practicing the method of this invention, an annular area is formed between the casing of the safe and the foundation and an outer shell is mounted against the foundation wall to form an interior annular area which is adapted to receive the protective enclosure of this invention. This description of the invention is intended as a summary only; the claims are representative of the scope of the invention contained herein.

BRIEF DESCRIPTION OF THE PREFERRED EMBODIMENT

FIG. 1 is a side-view in elevation of a safe mounted within a floor foundation having the damage prevention apparatus of this invention mounted therewith; and FIG. 2 is a sectional-view taken along line 2—2 of FIG. 1 further illustrating the functioning of the lower rim portion and the retaining pins in holding in place the protective enclosure of the damage prevention apparatus of this invention.

DETAILED DESCRIPTION OF THE PREFERRED EMBODIMENT

Figure 1:
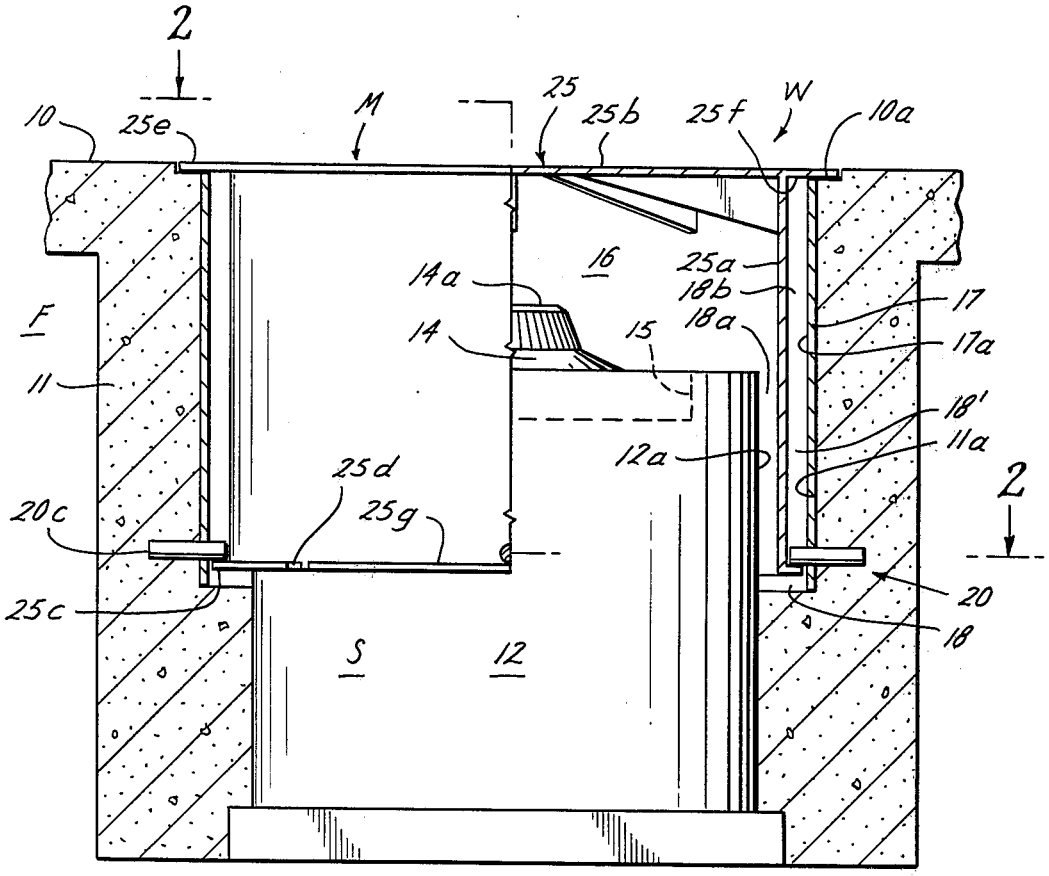
Figure 2:
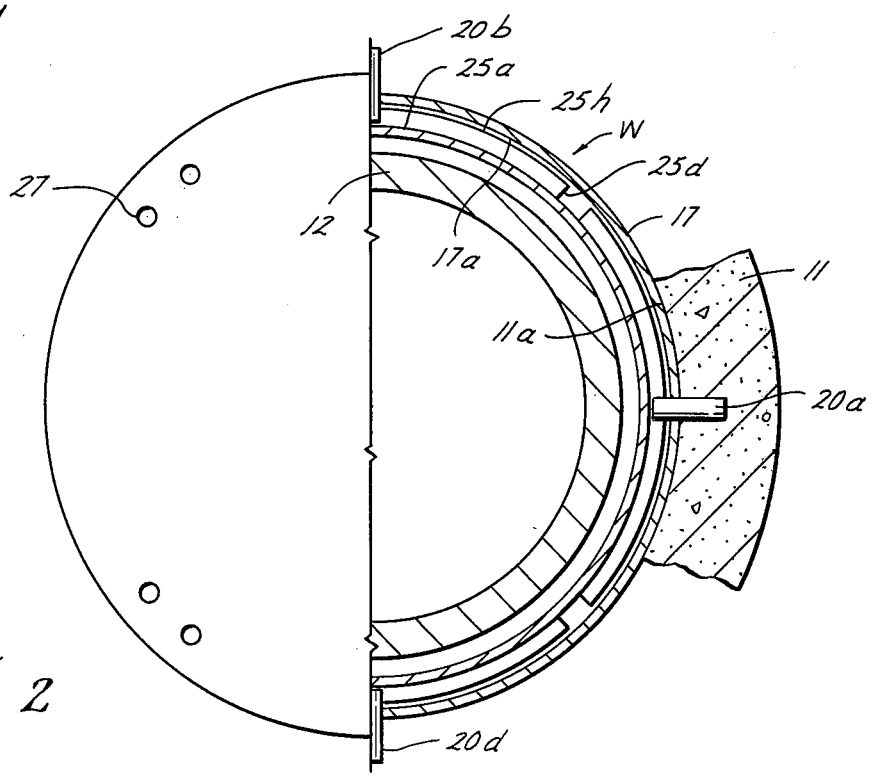

Referring to the drawings, the letter W generally designates the water damage prevention apparatus of the preferred embodiment of this invention mounted over a floor safe S positioned in a floor F, which is defined as having a floor surface 10 and a floor foundation 11. The floor safe S may be any particular type of floor safe. Typically, a floor safe such as S includes a floor safe casing 12 which may be cylindrical as depicted here or have another configuration. An openable top 14 is mounted over an opening 15 in the top of the floor safe casing 12 in a typical manner. The floor safe top 14 is depicted as being locked by a combination lock 14*a*. Of course, other types of locks may be utilized.

The protective means generally designated as M of the preferred embodiment of this invention is mounted over the floor safe S for trapping air in an interior area 16 between the protective means M and the floor safe to provide a pressure barrier to the intrusion of water into the area of the openable safe top 14.

The protective means M prevents the intrusion of water into the protected area or region 16 by utilizing the pressure of the air trapped within the region 16 to resist the pressure of intruding water thereby preventing possible leakage of water through the opening 15 formed between the safe door 14 and the top of the safe casing 12.

The protective means M includes an outer, substantially cylindrical shell 17 which is mounted in the annular area 18 formed between the exterior wall 12*a* of the floor safe casing and the interior wall 11*a* of the floor foundation 11. The outer substantially cylindrical shell 17 cooperates with the exterior floor safe casing wall 12*a* to define a slightly narrower annular area 18' which from this point forward in the description will be the annular area referred to to further describe the protective means M of this invention. Four retainer pins 20*a*, 20*b*, 20*c* and 20*d* form a retainer means generally designated as 20. Each of the pins 20*a*–20*d* is mounted into the floor foundation 11*a* and extends through the outer cylindrical shell 17 radially inwardly into the annular area 18'. The four retainer pins 20*a*–20*d* are equally spaced at 90° intervals about the interior wall 17*a* of the outer cylindrical shell 17. The pins are mounted into the wall by any suitably known method.

The protective means M includes a protective enclosure or cap generally designated as 25 for mounting over the openable top 14 and a part of the floor safe casing 12. The protective enclosure 25 includes a substantially cylindrical housing 25*a* which is formed with a top 25*b*. A bottom rim portion 25*c* is formed with and extends outwardly from the bottom of the substantially cylindrical cap housing 25a for engagement with the retainer pins 20a–20d which hold the protective enclosure in position. The protective enclosure 25 includes four slots 25d which are circumferentially spaced about the rim at 90° intervals for temporary alignment with the retainer pins 20a–20d during insertion of the protective cap 25 downwardly into the annular area 18'. Alignment of the slots 25d in the bottom enclosure rim 25c with the retainer pins 20a–20d allows for the rim 25c to be positioned below the retainer pins 20a–20d. The protective enclosure 25 is then rotated such that the slots 25d are out of alignment with the pins so that the pins function to prevent the protective cap 25 from being raised or floated upwardly when water enters the annular area 18a formed between the interior wall 25e of the substantially cylindrical enclosure housing 25a and the wall 12a of the floor safe casing 12.

The protective enclosure 25 further includes an upper rim 25e which is formed with and extends outwardly from the protective enclosure top 25b for positioning on an indented surface 10a formed in the floor surface 10.

The distance between the indented floor surface 10a and the bottom surface of the pins 20a–20d is substantially the same as the distance between the bottom annular face 25f of the top rim 25e and the top face 25g of the bottom rim 25c whereby the top and bottom rims 25e and 25c, respectively, cooperate with the retainer pins 20a–20d and indented floor surface 10a to mount the protective cap 25 reasonably tightly within the annular area 18'. In this manner, water flowing into the annular area 18' is partly limited by a partial seal between the bottom annular face 25f of the top rim 25e and the indented floor surface 10a. A plurality of finger holes 27 are formed in the top rim 25e but include bottom portions (not shown) which surround the finger holes to prevent water from entering into the annular area 18' through the finger holes 27.

In practicing the method of this invention, the protective means M may be mounted over an existing floor safe S or simultaneously with the installation of a new floor safe. In any event, the annular space 18 is formed between the outer wall 12a of the floor safe casing 12 and an inner foundation wall 11a. An outer substantially cylindrical support shell 17 is mounted against the foundation wall 11a and retainer pins 20a–20b are mounted into the floor foundation 11 for extension through the outer shell 17 radially inwardly into the annular space 18' formed between the inside shell wall 17a and the wall 12a of safe casing 12. The protective enclosure 25 is then mounted in the annular space 18' by alignment of slots 25d in lower or bottom rim 25c with retainer pins 20a–20d so that the lower rim portion 25c of the protective enclosure 25 may be positioned below the retainer pins. The protective enclosure is the rotated in either direction to a position of non-alignment with respect to the slots 25d and the retainer pins 20a–20d. Due to the substantially equal distances between the bottom of the pins 20a–20d and the indented surface 10a of the floor surface 10 and the distance between the top face 25g of the lower enclosure rim 25c and the bottom face 25f of the top or upper rim 25e, the protective enclosure is held substantially tightly in position. In this manner, the flow of water into the annular space 18' is impeded to some extent by the engagement of the lower face 25f of the rim 25e at the indented surface 10a. Water enters the annular space 18b between the substantially cylindrical enclosure housing 25a and the wall 17a of the outer substantially cylindrical shell 17 flows downwardly around the bottom rim 25c and upwardly into the annular area 18a between the protective enclosure cylindrical housing 25a and the wall 12a of safe casing 12. The outer edge 25h of the lower rim 25, due to the annular thickness of the annular lower rim 25c, is very close to the inner wall 17a of the outer substantially cylindrical shell 17, which serves to somewhat limit the flow of water up into the annular area 18a. As water enters the annular area 18a, the air trapped within the region 16 between the safe S and the enclosure 25 is compressed. Eventually, an equilibrium point is reached where the pressure of the air compressed within the interior region 16 is equal to the pressure of the water rising in the annular area 18a between the protective enclosure 25 and the wall 12a of safe casing 12. When equilibrium occurs, the water no longer arises. Unless the overall height of water above the floor surface reaches unusually high levels, equilibrium pressure within the region 16 will be reached before the water in annular area 18 will rise over the safe casing 12 and flow about the openable top 14. After the flooding is over, the protective enclosure 25 may be removed and during such removal the lower rim 25c may act as an annular piston to push out the annular area 18b some of the water in this area.

The configuration for the floor safe casing 12 has been described as being cylindrical. It is within the scope of this invention to apply the invention to floor safes having casings of other configurations such as rectangular. If the configuration of the floor safe casing 12 is rectangular, the configuration of the protective enclosure housing 25a and of lower rim 25c and upper rim 25e as well as outer shell 17 will also be rectangular. It is evident that the advantages of this invention are significant. Among these advantages is the opportunity to prevent water damage to the floor safe S without having to make the floor safe S airtight, the disadvantages of which having been described earlier.

The foregoing disclosure and description of the invention are illustrative and explanatory thereof, and various changes in the size, shape and materials as well as in the details of the illustrated construction may be made without departing from the spirit and scope of the invention.

I claim:

1. Apparatus for preventing water from damaging a floor safe or other similarly mounted device, comprising:

protective means adapted for positioning over the openable top and a part of the casing of a floor safe for trapping air between said protective means and such floor safe to prevent the intrusion of water into the region of the openable top of the floor safe by utilizing the pressure of the trapped air to resist the pressure of the intruding water thereby preventing possible leakage into the interior of the safe.

2. The structure set forth in claim 1, wherein said protective means includes:

a protective enclosure including a substantially cylindrical housing having a top attached therewith, said protective enclosure being adapted for mounting over the openable top and a part of the casing of the floor safe and including a lower rim portion; and retainer means mounted adjacent to said lower rim portion for retaining said protective enclosure in position during intrusion of water.

3. The structure set forth in claim 1, wherein said retainer means includes:

a plurality of pins and pin mounting means mounting said pins for positioning over said lower rim portion for holding said protective enclosure in position during intrusion of water.

4. The structure set forth in claim 2, including:

an upper rim portion adapted for positioning onto a portion of the floor for at least partly limiting the flow of water into the area between said cylindrical enclosure housing and the part of the floor safe casing over which said protective enclosure is positioned.

5. The structure set forth in claim 1, including:

an outer substantially cylindrical shell adapted for mounting between the floor safe casing and the floor foundation in which such floor safe is mounted to form an annular area therebetween; and a plurality of retainer pins mounted in said shell and extending radially inwardly into the annular area between said outer shell and the floor safe casing.

6. The structure set forth in claim 5, including:

a protective enclosure including a substantially cylindrical housing having a top attached therewith, said protective enclosure being adapted for mounting over the opening and a part of the floor safe casing with said substantially cylindrical protective enclosure housing being positioned in the annular area between the floor safe casing and the outer substantially cylindrical shell and said top of said protective enclosure being positioned over the openable top of the floor safe to form a protected area between the floor safe and the protective enclosure in which air is entrapped to provide pressure resistance to intruding water.

7. The structure set forth in claim 6, including:

an annular lower rim portion being attached to and extending outwardly from said cylindrical housing of said protective enclosure for engagement with said retainer pins such that said retaining pins hold said protective enclosure in position over the floor safe.

8. The structure set forth in claim 7, including:

said lower rim portion having a plurality of slots for initial alignment with said retainer pins so that said lower rim portion of said protective enclosure is positionable under said retainer pins by initial alignment of said slots with said pins and subsequent rotation of said protective enclosure to a position of non-alignment between said pins and said slots.

9. The structure set forth in claim 8, including:

an upper annular rim extending outwardly from said protective enclosure into engagement with an upper surface of the floor in which such floor safe is mounted, the distance between said upper and lower rims being approximately the same as the distance between said retainer pins and the upper floor surface engaged by said upper rim.

10. The structure set forth in claim 7, including:

the lower rim portion having an outer edge which is substantially adjacent to said cylindrical shell such that at least some intruding water is removable by lifting said protective enclosure upwardly out of said annular area with said lower rim acting as an annular piston to remove such water.

11. A method for protecting a floor safe which is mounted in an opening in a foundation, such floor safe having an openable top which is typically accessible only through a lock, comprising the steps of:

forming an annular area between the cylindrical casing of the floor safe and the foundation in which the floor safe is mounted;

mounting an outer substantially cylindrical support member against the outer foundation wall;

mounting a protective enclosure which includes a substantially cylindrical housing and a top attached therewith over the floor safe in the annular area between the floor safe and the outer substantially cylindrical shell in order to provide an interior, protective space in which ambient air is trapped;

retaining the protective enclosure in position by mounting a plurality of pins in the outer support member which pins are radially directed into the annular area between the substantially cylindrical outer shell and the floor safe casing; and, providing a lower annular rim on the substantially cylindrical housing of the protective enclosure for positioning under the retainer pins such that the retainer pins hold the protective enclosure in its protecting position about the floor safe whereby the entrapped air within the interior area between the floor safe and the protective enclosure provides sufficient pressure to halt the intrusion of water into the protective area before the water reaches the level of the openable top of the floor safe.

* * * * *